US008701929B1

(12) United States Patent
Long et al.

(10) Patent No.: US 8,701,929 B1
(45) Date of Patent: Apr. 22, 2014

(54) PORTABLE GAS CAN

(71) Applicants: Cheri Long, Beverly, OH (US); Jerry Long, Beverly, OH (US)

(72) Inventors: Cheri Long, Beverly, OH (US); Jerry Long, Beverly, OH (US)

( * ) Notice: Subject to any disclaimer, the term of this patent is extended or adjusted under 35 U.S.C. 154(b) by 0 days.

(21) Appl. No.: 13/764,929

(22) Filed: Feb. 12, 2013

(51) Int. Cl.

| | |
|---|---|
| ***B67D 7/06*** | (2010.01) |
| ***B67D 3/00*** | (2006.01) |
| *B67D 7/04* | (2010.01) |
| *B65D 25/18* | (2006.01) |
| *B65D 88/56* | (2006.01) |
| *B60K 15/03* | (2006.01) |

(52) U.S. Cl.
CPC ... *B67D 3/00* (2013.01); *B67D 7/04* (2013.01); *B65D 25/18* (2013.01); *B65D 88/56* (2013.01); *B60K 15/03006* (2013.01)
USPC ..... 220/729; 220/620; 220/629; 222/158; 222/571; 222/130; 222/482; 222/401; 215/395; 215/276

(58) Field of Classification Search
CPC ..... B67D 3/00; B67D 7/04; B67D 25/00; B67D 88/56; B60K 15/03006
USPC ..... 220/620, 629; 222/401, 158, 130, 108, 222/571; 215/395, 276
See application file for complete search history.

(56) References Cited

U.S. PATENT DOCUMENTS

| | | | | |
|---|---|---|---|---|
| 1,331,409 | A | 2/1920 | Barnett | |
| 2,400,197 | A * | 5/1946 | Grodin | 206/499 |
| 2,743,844 | A * | 5/1956 | Livingstone | 222/111 |
| 3,587,453 | A * | 6/1971 | Klein | 101/480 |
| 3,697,093 | A | 10/1972 | Cadiou | |
| 3,746,200 | A * | 7/1973 | Flider | 215/10 |
| 4,298,145 | A * | 11/1981 | Iida | 222/478 |
| 4,351,454 | A * | 9/1982 | Maynard, Jr. | 222/143 |
| 4,416,396 | A * | 11/1983 | Ward | 222/129 |
| 4,637,530 | A * | 1/1987 | Jiang | 222/564 |
| 4,911,562 | A | 3/1990 | Mazzeschi | |
| 4,923,098 | A * | 5/1990 | Schoonover et al. | 222/465.1 |
| 4,969,571 | A * | 11/1990 | Bartz | 220/771 |
| 4,989,757 | A * | 2/1991 | Krall | 222/111 |
| 5,083,672 | A * | 1/1992 | Lewandowski | 215/322 |
| D326,050 | S | 5/1992 | Stockstill | |
| 5,226,574 | A * | 7/1993 | Durinzi, Jr. | 222/465.1 |
| 5,301,829 | A * | 4/1994 | Chrisco | 220/521 |
| 5,388,792 | A * | 2/1995 | Hastings et al. | 248/188.1 |
| D365,520 | S | 12/1995 | Luther | |
| 5,564,608 | A | 10/1996 | Cooper | |
| 6,158,702 | A * | 12/2000 | Kump | 248/206.2 |
| 6,270,488 | B1 * | 8/2001 | Johnson et al. | 604/403 |
| 6,842,337 | B2 * | 1/2005 | Helot et al. | 361/679.59 |

(Continued)

*Primary Examiner* — Mickey Yu
*Assistant Examiner* — Gideon Weinerth
(74) *Attorney, Agent, or Firm* — Kyle A. Fletcher, Esq.

(57) ABSTRACT

The improved portable gas can includes adjustable legs along a bottom surface, which aid in stabilizing the gas can on a floor of a vehicle while in transit. The gas can includes an extension leg that is also located on the bottom surface, and which is able to secure the gas can by engaging between the truck bed surface and the tail gate. The extension leg is comprises of a lateral member and a second member pivotably engaged thereto. The second member of the extension leg is configured to extends and engage in between the truck bed and tail gate of a truck thereby securing the gas can in place while in transit. The gas can further includes a recess handle along a front surface as well as a handle positioned atop of the gas can to aid in manipulating and carrying the gas can.

15 Claims, 8 Drawing Sheets

(56) References Cited

U.S. PATENT DOCUMENTS

| | | | | |
|---|---|---|---|---|
| 6,921,661 | B2 * | 7/2005 | Nagy et al. | 435/290.1 |
| 7,360,980 | B2 | 4/2008 | Brewer | |
| 7,374,064 | B2 * | 5/2008 | Robinson | 220/629 |
| 7,427,076 | B2 * | 9/2008 | Gwin | 280/79.2 |
| 7,467,728 | B2 * | 12/2008 | Lundy et al. | 220/629 |
| D608,855 | S | 1/2010 | Hatch | |
| 7,762,418 | B1 * | 7/2010 | Natale | 220/23.87 |
| 7,959,044 | B1 * | 6/2011 | Christian et al. | 222/468 |
| 8,033,417 | B1 * | 10/2011 | Fallacaro | 220/629 |
| 8,365,939 | B2 * | 2/2013 | Dygert et al. | 220/23.91 |
| 2003/0076017 | A1 * | 4/2003 | Helot et al. | 312/223.2 |
| 2004/0089679 | A1 * | 5/2004 | Tackett | 222/561 |
| 2012/0248104 | A1 * | 10/2012 | Cannady | 220/4.12 |
| 2012/0292359 | A1 * | 11/2012 | O'Dell | 224/403 |

* cited by examiner

PORTABLE GAS CAN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of gas cans, more specifically, a portable gas can with adjustable legs and a spout slider.

Gas cans have long been a helpful tool in refueling any gas-powered device. Hand-held gas cans do not have means with which to stabilize itself between pouring uses, which is especially useful while the gas can is in transit.

What is needed is a portable gas can that includes legs that stabilize the gas can on a floor of a vehicle, and which includes another extension leg that can be sandwiched between the truck bed and the tail gate of a truck in order to further stabilize the gas can during transit. The device of the present application addresses these needs, and includes further features aimed at preventing a gas can from tilting over, and further sealing off the contents inside of the gas can.

B. Discussion of the Prior Art

As will be discussed immediately below, no prior art discloses a portable gas can that includes adjustable legs along a bottom surface, which aid in stabilizing the gas can on a floor of a vehicle while in transit; wherein the gas can includes an extension leg that is also located on the bottom surface; wherein the extension leg is comprised of a lateral member and a second member pivotably engaged thereto; wherein the second member of the extension leg is configured to extends and engage in between a truck bed and tail gate of a truck; wherein the gas can further includes a recess handle along a front surface as well as a handle positioned atop of the gas can; wherein the gas can further includes a spout with a spout sliding member that is integrated therein, and which slides to open and close off fluid communication between the spout and the interior of the gas can.

The Cooper Patent (U.S. Pat. No. 5,564,608) discloses a transportable safety gasoline container. However, the container does not include legs that stabilize the container while in transit.

The Mazzeschi Patent (U.S. Pat. No. 4,911,562) discloses a collapsible can with a handle arrangement for pouring the liquid held therein. Again, the collapsible can does not include legs that further stabilize the can or container while in transit.

The Brewer Patent (U.S. Pat. No. 7,360,980) discloses a fuel container retractable safety strap. Again, the fuel container does not include legs that adjust with respect to the bottom of the container in order to stabilize the fuel container during transit.

The Cadiou Patent (U.S. Pat. No. 3,697,093) discloses a gasoline tank or like container that is fastened to a vehicle, which includes securement straps. However, the tank does not feature legs that work to stabilize the tank on a floor of a vehicle while in transit.

The Barnett et al. Patent (U.S. Pat. No. 1,331,409) discloses an oil can with an auxiliary handle located on the bottom to help with pouring. Again, the oil can includes no legs to stabilize the oil can during transit.

The Hatch et al. Patent (U.S. Pat. No. Des. 608,855) illustrates an ornamental design for a gasoline can. Again, the gasoline can does not include legs to stabilize the can on a floor surface of a vehicle while in transit.

While the above-described devices fulfill their respective and particular objects and requirements, they do not describe a portable gas can that includes adjustable legs along a bottom surface, which aid in stabilizing the gas can on a floor of a vehicle while in transit; wherein the gas can includes an extension leg that is also located on the bottom surface; wherein the extension leg is comprised of a lateral member and a second member pivotably engaged thereto; wherein the second member of the extension leg is configured to extends and engage in between a truck bed and tail gate of a truck; wherein the gas can further includes a recess handle along a front surface as well as a handle positioned atop of the gas can; wherein the gas can further includes a spout with a spout sliding member that is integrated therein, and which slides to open and close off fluid communication between the spout and the interior of the gas can. In this regard, the improved portable gas can departs from the conventional concepts and designs of the prior art.

SUMMARY OF THE INVENTION

The improved portable gas can includes adjustable legs along a bottom surface, which aid in stabilizing the gas can on a floor of a vehicle while in transit. The gas can includes an extension leg that is also located on the bottom surface, and which is able to secure the gas can by engaging between the truck bed surface and the tail gate. The extension leg is comprised of a lateral member and a second member pivotably engaged thereto. The second member of the extension leg is configured to extends and engage in between the truck bed and tail gate of a truck thereby securing the gas can in place while in transit. The gas can further includes a recess handle along a front surface as well as a handle positioned atop of the gas can to aid in manipulating and carrying the gas can. The gas can further includes a spout with a spout sliding member that is integrated therein, and which slides to open and close off fluid communication between the spout and the interior of the gas can.

It is an object of the invention to provide a gas can that includes means with which to stabilize the gas can to a floor of a vehicle while in transit so as to prevent tipping over while in transit.

A further object of the invention is to provide adjustable legs along a bottom surface, which aid in stabilizing the gas can during transit.

An even further object of the invention is to provide adjustable legs that either extend in and out from slots integrated into the bottom surface of the gas can or which rotate outwardly from a pivot point along the bottom surface of the gas can.

A further object of the invention is to provide an extension leg that is also included on the gas can, and which extends to engage in between a tail gate and truck bed of a truck so as to aid in preventing tipping over of the gas can while in transit.

A further object of the invention is to provide a recess handle along a front surface, which aids in grasping and manipulating the gas can.

A further object of the invention is to provide a handle along a top of the gas can that aids in carrying and/or manipulating the gas can when pouring the contents therefrom. A further object of the invention is to include a spout with a spout sliding member that is integrated therein, and which slides to open and close off fluid communication between the spout and the interior of the gas can.

Another object of the invention is to provide a canal along a forward portion of the spout so as to collect any excess gas that may spill from or otherwise spill onto the gas can during filling up the gas can or pouring from the gas can.

These together with additional objects, features and advantages of the improved portable gas can will be readily apparent to those of ordinary skill in the art upon reading the following detailed description of presently preferred, but nonetheless illustrative, embodiments of the improved portable gas can when taken in conjunction with the accompanying drawings.

In this respect, before explaining the current embodiments of the improved portable gas can in detail, it is to be understood that the improved portable gas can is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved portable gas can.

It is therefore important that the claims be regarded as including such equivalent construction insofar as they do not depart from the spirit and scope of the improved portable gas can. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
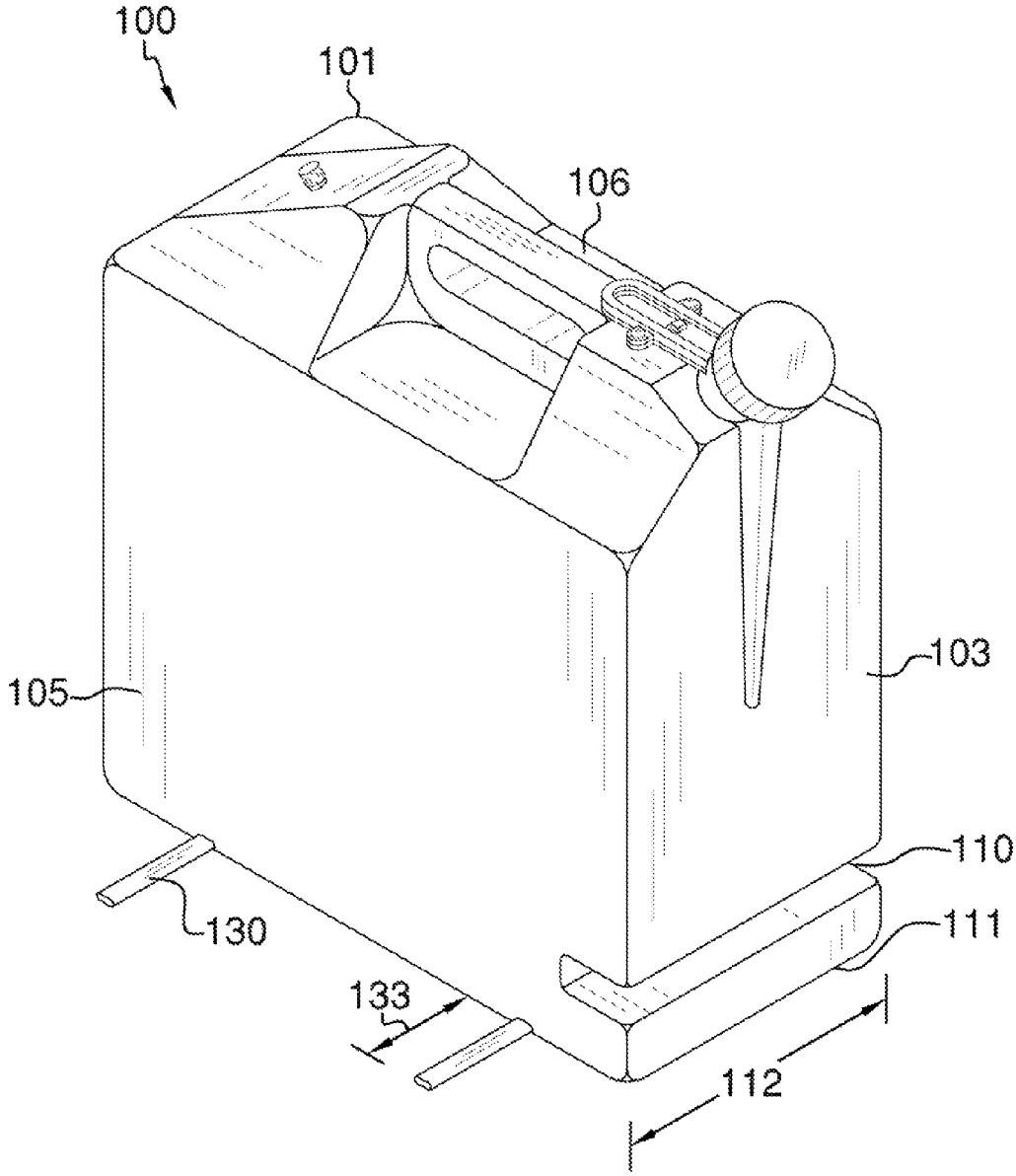
FIG. 1 illustrates a perspective view of the improved portable gas can.
Figure 2:
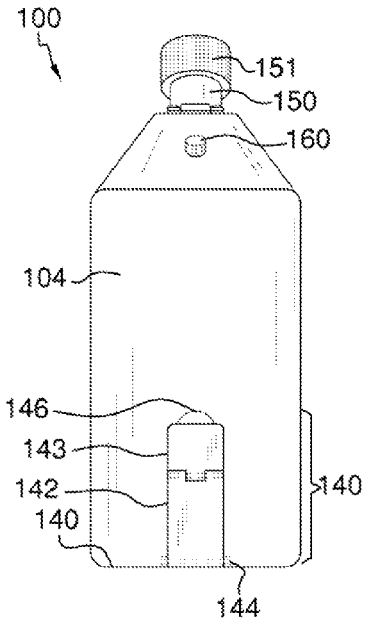
FIG. 2 illustrates a rear end view of the improved portable gas can.
Figure 3:
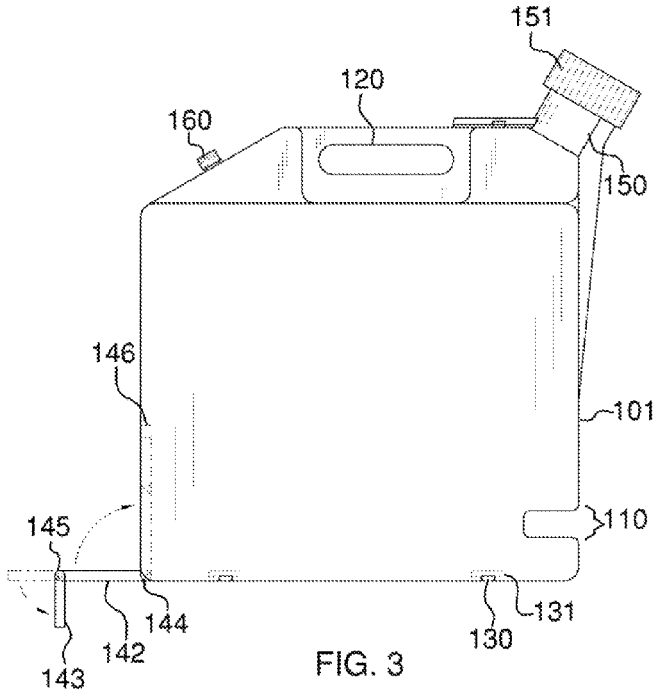
FIG. 3 illustrates a side view of the improved portable gas can further detailing the rotation of the extension leg.
Figure 4:
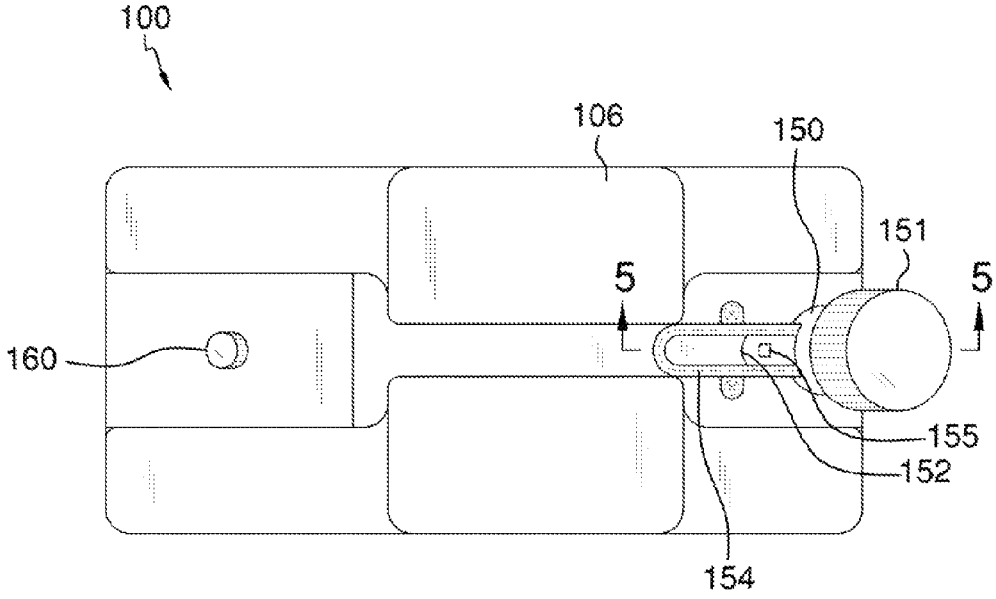
FIG. 4 illustrates a top view of the improved portable gas can.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-8. An improved portable gas can 100 (hereinafter invention) includes a gas can housing 101 that is further defined with a bottom surface 102, a front surface 103, a rear surface 104, side surfaces 105, and a top surface 106.

The front surface 103 includes a handle recess 110 that is located near a bottom, front edge 111, and which aids in grasping of the invention 100 when pouring contents therefrom. The handle recess 110 is essentially a notch that extends across a width 112 of the front surface 103.

The invention 100 includes a handle 120 that is located along the top surface 106. The handle 120 is used to aid in carrying the invention 100 as needed.

The invention 100 includes adjustable legs 130 that are affixed to the bottom surface 102. The adjustable legs 130 extend laterally to further stabilize the invention 100 when resting on a floor 201 of a vehicle 200. The bottom surface 102 includes notches 131 thereon, which enable the adjustable legs 130 to extend and retract therein. It is important to note that the adjustable legs 130 are able to extend laterally from the bottom surface 102. The adjustable legs 130 extend an adjustment length 133, which extends laterally from the side surfaces 105.

Figure 8:
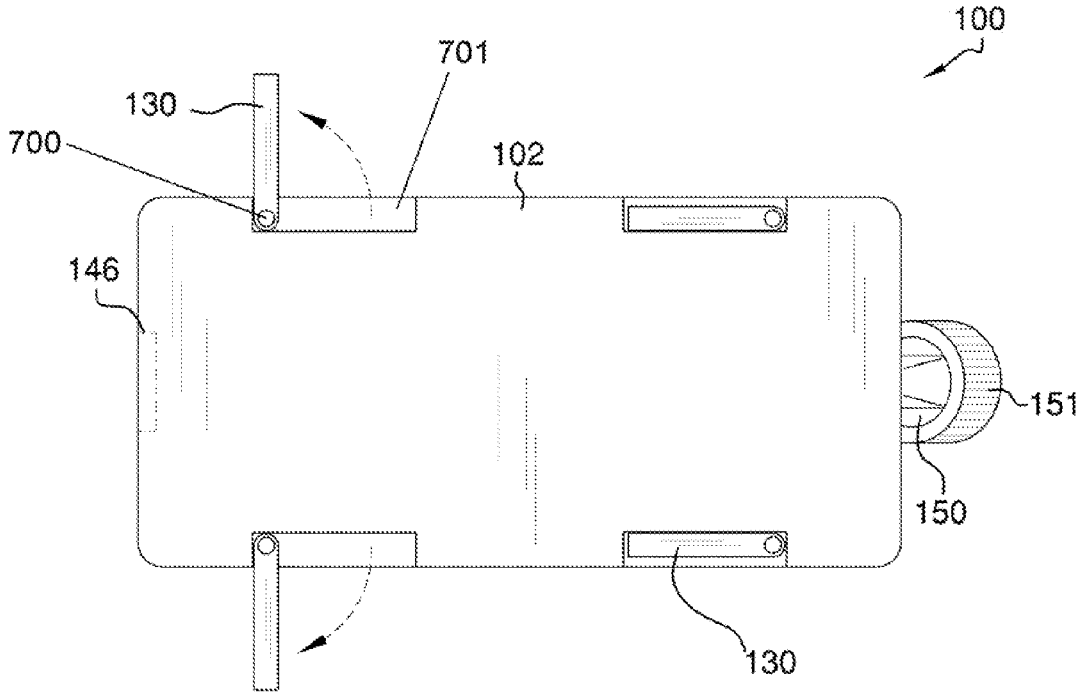
FIG. 8 illustrates a bottom view of the improved portable gas can depicting the adjustable legs in a rotational embodiment, and extending outwardly from a pivot point.

Referring to FIG. 8, the adjustable legs 130 rotate about a pivot point 700 provided on the bottom surface 102 of the invention 100. Moreover, the bottom surface 102 includes pivot notches 701, which enable the adjustable legs 130 to rotate from a retracted state to an extended state. The adjustable legs 130 when in a retracted state are flush with the bottom surface 102 of the invention 100, and are able to rotate outwardly 90 degrees in order to aid in stabilizing the invention 100.

The invention 100 includes an extension leg 140 that is integrated into the rear surface 104. More specifically, the extension leg 140 rotates out from the rear surface 104 at a bottom, rear edge 141 of the gas can housing 101. The extension leg 140 is further defined as including a first member 142 and a second member 143. The first member 142 is attached to the rear surface 104 via a first pivot member 144. The second pivot member 143 is attached to the first member 142 via a second pivot member 145. The extension leg 140 is designed to extend down from the rear surface 104, and engage between a tail gate 202 and the floor 201 of the vehicle 200 so as to lock the invention 100 in place thereon. The extension leg 140 may be used in conjunction with the adjustable legs 130 or by itself in order to stabilize the invention 100 with respect to the vehicle 200.

The extension leg 140 is able to fold flat against the rear surface 104 of the gas can housing 101. Moreover, the rear surface 104 includes an extension leg cavity 146 therein, which enables the extension leg 140 to fold flat and be secured in place there against when not in use.

The invention 100 includes a spout 150 that is located along the top surface 106 of the gas can housing 101. The spout 150 enables the contents of the gas can housing 101 to be poured and dispensed therefrom. The spout 150 includes a cap member 151 that is threadably engaged thereto, and which is unscrewed to expose the spout 150 for pouring.

Figure 5A:
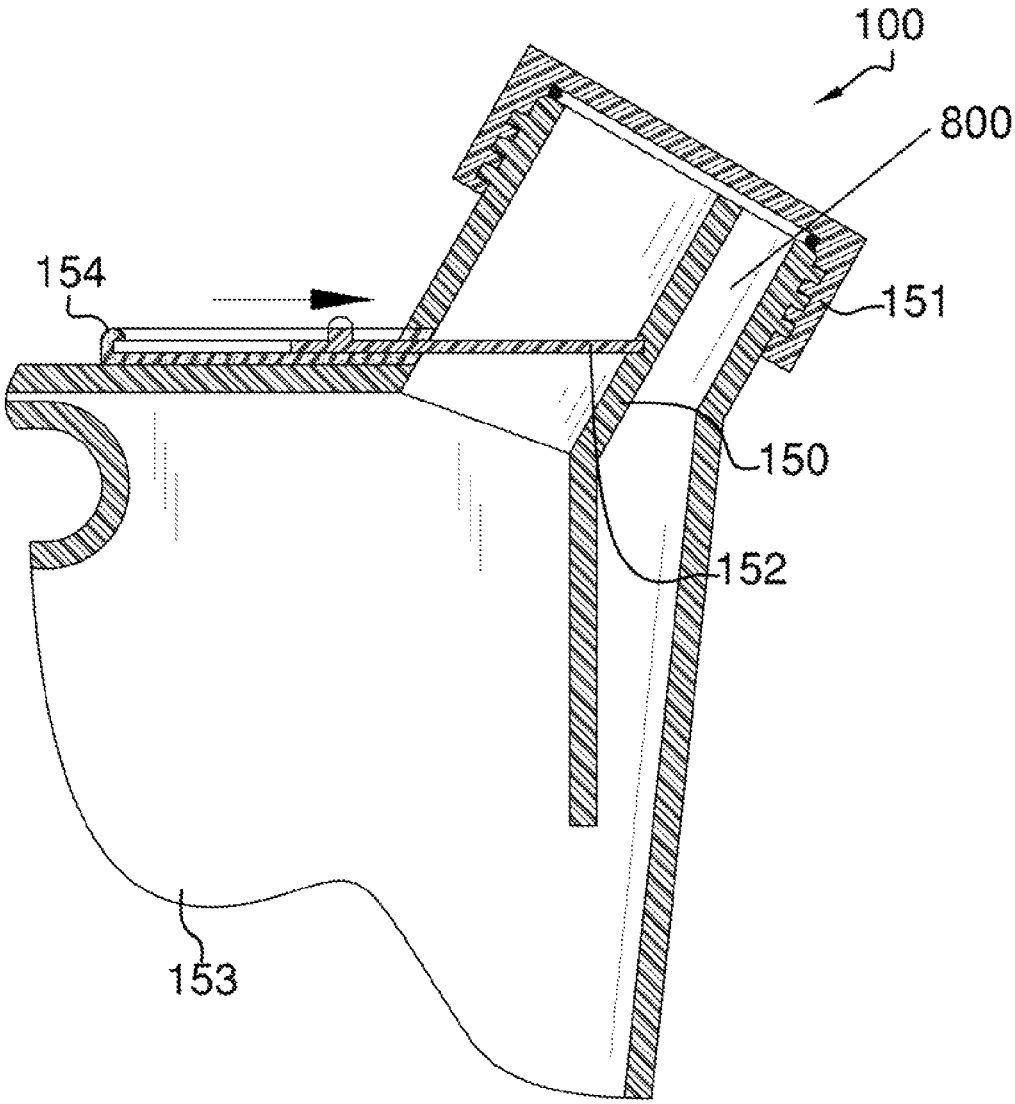
FIG. 5A illustrates a cross-sectional view along line 5-5 in FIG. 4, and depicting the translational movement of the sliding spout member inside of the spout.
Figure 5B:
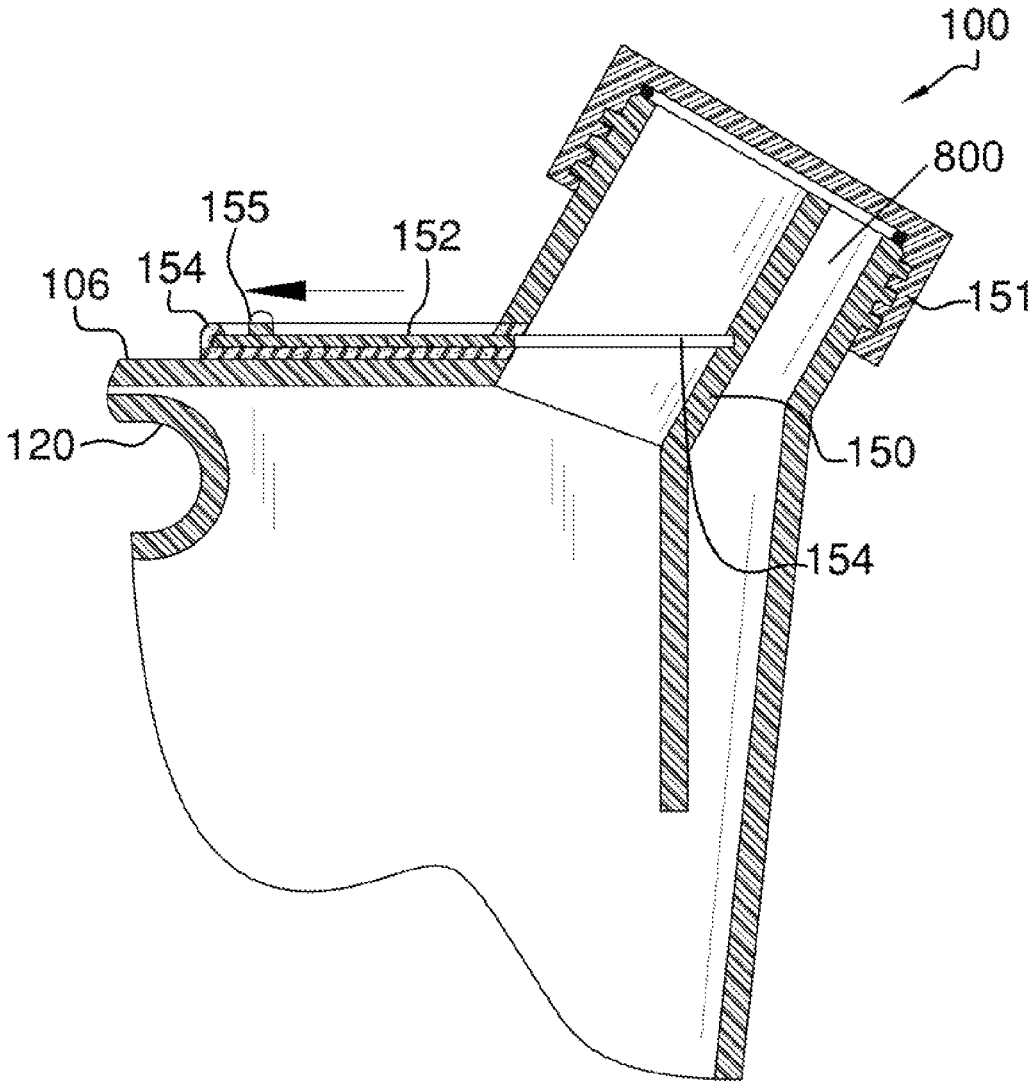
FIG. 5B illustrates a cross-sectional view along line 5-5 in FIG. 4, and depicting the sliding spout member sliding rearwardly to restore fluid communication between the spout and the interior of the gas can.
Figure 6:
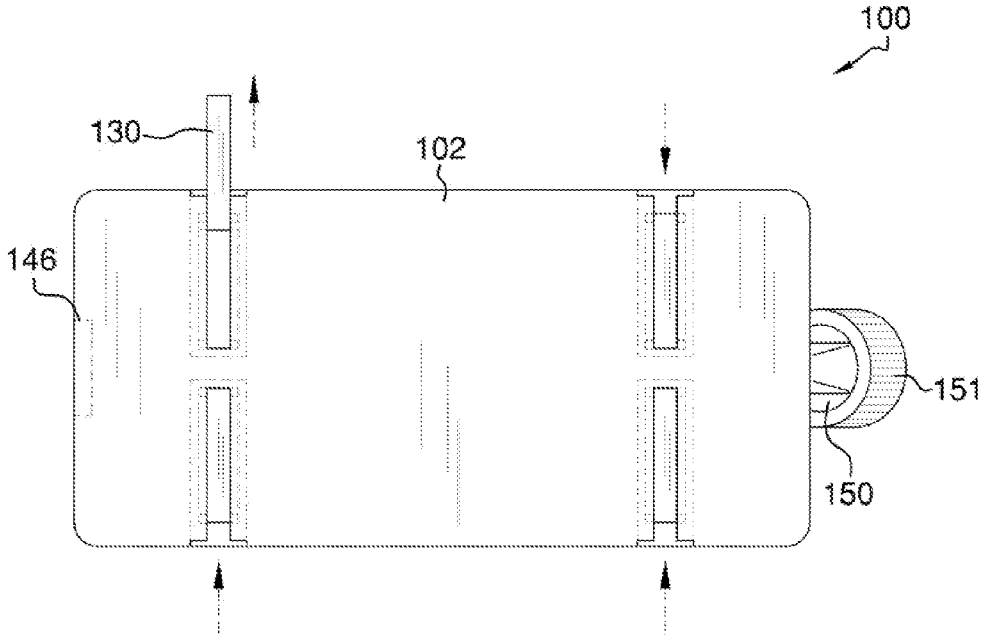
FIG. 6 illustrates a bottom view of the improved portable gas can depicting the adjustable legs extending outwardly.
Figure 7:
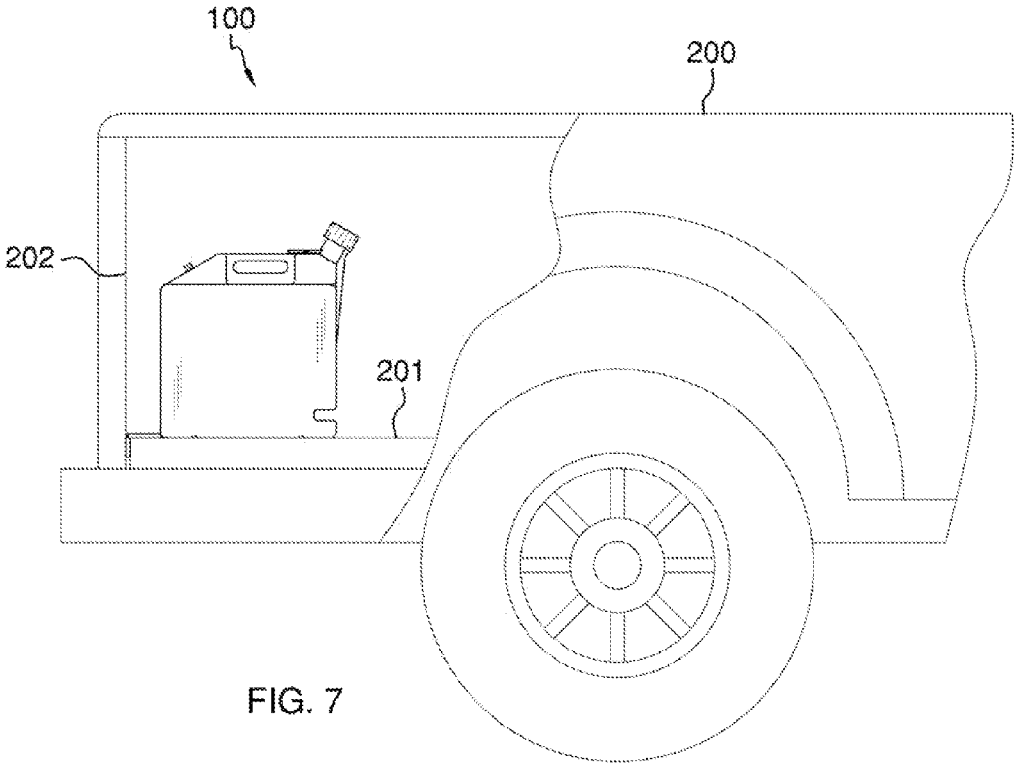
FIG. 7 illustrates a side view of the improved portable gas can in use and secured to the truck bed via the extension leg that is secured between the truck bed and the tail gate.

Referring to FIGS. 5A-B, the spout 150 has a sliding spout member 152 integrated therein, which regulates fluid communication between the spout 150 and an interior 153 of the gas can container 101. The sliding spout member 152 is able to slide forwardly and backwardly along the top surface 106 in order to close off or open the pathway between the interior 153 and the spout 150. The sliding spout member 152 travels forwardly and backwardly along a track 154 that is integrated inside of the spout 150 as well as atop of the top surface 106. The sliding spout member 152 includes a sliding tab 155 that is positioned atop of the sliding spout member 152, and which is visibly above the top surface 106. The sliding tab 155 enables manipulation of the sliding spout member 152 back and forth with respect to the track 154. It shall be noted that the track 154 is located both inside of the spout 150 and along the top surface 106 of the gas can container 101, and which ensures translational movement of the sliding spout member 152 both inside of the spout 150 as well as along the top surface 106 of the gas can container 101.

The spout 150 may further include a canal 800 integrated into a forward portion of the spout 150. Essentially, the canal 800 involves a small portion of the spout 150, and is included in order to collect excess fuel, gasoline, or diesel from spilling onto the exterior surface of the invention 100. Moreover, the canal 800 directs any excess fuel back into the main portion of the invention 100. It shall be noted that during filling up the invention 100 with fuel or pouring fuel from the invention 100, excess fuel may otherwise spill from the invention 100, and the canal 800 collects what would otherwise be wasted fuel.

The invention 100 may further include an air vent 160 located elsewhere with respect to the gas can container 101. More specifically, the air vent 160 is located on an opposite side of the top surface 106 in order for an abatement of a vacuum that occurs when dispensing contents from the interior 153 of the gas can housing 101.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable gas can comprising:

a gas can housing along a bottom surface of which is a plurality of adjustable legs that extend laterally, and are configured to further stabilize the gas can housing on a floor of a vehicle during transit;

wherein the gas can housing includes a spout along a top surface, and which includes a sliding spout member that is able to slide forwardly and backwardly in order to close off or open fluid communication between the spout and an interior of the gas can housing;

wherein the gas can housing is further defined with a front surface, a rear surface, and side surfaces;

wherein an extension leg is integrated into the rear surface of the gas can housing, and is configured to secure itself between a tail gate and floor of said vehicle;

wherein the extension leg rotates out from the rear surface at a bottom, rear edge of the gas can housing;

wherein the extension leg is further defined as including a first member and a second member; wherein the first member is attached to the rear surface via a first pivot member; wherein the second pivot member is attached to the first member via a second pivot member; wherein the second member of the extension leg is designed to extend down from the rear surface, and engage between the tail gate and the floor of the vehicle.

2. The portable gas can as described in claim 1 wherein the front surface includes a handle recess that is located near a bottom, front edge of the gas can housing, and which aids in grasping of the gas can housing when pouring contents therefrom.

3. The portable gas can as described in claim 2 wherein the handle recess is a notch that extends across a width of the front surface.

4. The portable gas can as described in claim 1 wherein a handle is located along the top surface; wherein the handle is used to aid in carrying the gas can housing as needed.

5. The portable gas can as described in claim 1 wherein the adjustable legs are affixed to the bottom surface, and extend laterally; wherein the bottom surface includes notches thereon, which enable the adjustable legs to extend and retract therein; wherein the adjustable legs extend an adjustment length, which extends laterally from the side surfaces of the gas can housing.

6. The portable gas can as described in claim 1 wherein the extension leg able to fold flat against the rear surface of the gas can housing; wherein the rear surface includes an extension leg cavity therein, which enables the extension leg to fold flat and be secured in place there against when not in use.

7. The portable gas can as described in claim 1 wherein the spout includes a cap member that is threadably engaged thereto, and which is unscrewed to expose the spout for pouring; wherein the sliding spout member travels forwardly and backwardly along a track that is integrated inside of the spout as well as atop of the top surface of the gas can housing; wherein the sliding spout member includes a sliding tab that is positioned atop of the sliding spout member, and which is visibly above the top surface; wherein the sliding tab enables manipulation of the sliding spout member back and forth with respect to the track.

8. The portable gas can as described in claim 1 wherein the adjustable legs rotate about a pivot point provided on the bottom surface; wherein the bottom surface includes pivot notches, which enable the adjustable legs to rotate from a retracted state to an extended state; wherein the adjustable legs when in a retracted state are flush with the bottom surface, and are able to rotate outwardly 90 degrees when in use.

9. The portable gas can as described in claim 1 wherein the spout include a canal integrated into a forward portion of the spout; wherein the canal is in fluid communication with the interior of the gas can housing; wherein the canal involves a small portion of the spout, and is included in order to collect excess fuel from spilling onto the gas can housing.

10. A portable gas can comprising:

a gas can housing along a bottom surface of which is a plurality of adjustable legs that extend laterally, and are configured to further stabilize the gas can housing on a floor of a vehicle during transit;

wherein the gas can housing includes a spout along a top surface, and which includes a sliding spout member that is able to slide forwardly and backwardly in order to close off or open fluid communication between the spout and an interior of the gas can housing;

wherein the gas can housing is further defined with a front surface, a rear surface, and side surfaces;

wherein the front surface includes a handle recess that is located near a bottom, front edge of the gas can housing, and which aids in grasping of the gas can housing when pouring contents therefrom;

wherein the handle recess is a notch that extends across a width of the front surface;

wherein an extension leg is integrated into the rear surface of the gas can housing, and is configured to secure itself between a tail gate and floor of said vehicle; wherein the extension leg rotates out from the rear surface at a bottom, rear edge of the gas can housing; wherein the extension leg is further defined as including a first member and a second member; wherein the first member is attached to the rear surface via a first pivot member; wherein the second pivot member is attached to the first member via a second pivot member; wherein the second member of the extension leg is designed to extend down from the rear surface, and engage between the tail gate and the floor of the vehicle; wherein the extension leg able to fold flat against the rear surface of the gas can housing; wherein the rear surface includes an extension leg cavity therein, which enables the extension leg to fold flat and be secured in place there against when not in use.

11. The portable gas can as described in claim 10 wherein a handle is located along the top surface; wherein the handle is used to aid in carrying the gas can housing as needed.

12. The portable gas can as described in claim 10 wherein the adjustable legs are affixed to the bottom surface, and extend laterally; wherein the bottom surface includes notches thereon, which enable the adjustable legs to extend and retract therein; wherein the adjustable legs extend an adjustment length, which extends laterally from the side surfaces of the gas can housing.

13. The portable gas can as described in claim 10 wherein the spout includes a cap member that is threadably engaged thereto, and which is unscrewed to expose the spout for pouring; wherein the sliding spout member travels forwardly and backwardly along a track that is integrated inside of the spout as well as atop of the top surface of the gas can housing; wherein the sliding spout member includes a sliding tab that is positioned atop of the sliding spout member, and which is visibly above the top surface; wherein the sliding tab enables manipulation of the sliding spout member back and forth with respect to the track.

14. The portable gas can as described in claim 10 wherein the adjustable legs rotate about a pivot point provided on the bottom surface; wherein the bottom surface includes pivot notches, which enable the adjustable legs to rotate from a retracted state to an extended state; wherein the adjustable legs when in a retracted state are flush with the bottom surface, and are able to rotate outwardly 90 degrees when in use.

15. The portable gas can as described in claim 10 wherein the spout include a canal integrated into a forward portion of the spout; wherein the canal is in fluid communication with the interior of the gas can housing; wherein the canal involves a small portion of the spout, and is included in order to collect excess fuel from spilling onto the gas can housing.

* * * * *